US005830420A

United States Patent [19]

Borowiec et al.

[11] Patent Number: 5,830,420

[45] Date of Patent: Nov. 3, 1998

[54] METHOD TO UPGRADE TITANIA SLAG AND RESULTING PRODUCT

[75] Inventors: Krzysztof Borowiec, Tracy; Alfonso E. Grau, St-Bruno; Michel Gueguin; Jean-François Turgeon, both of Tracy, all of Canada

[73] Assignee: QIT-Fer et Titane Inc., Quebec, Canada

[21] Appl. No.: 561,602

[22] Filed: Nov. 21, 1995

[51] Int. Cl.[6] ..... C01G 23/00; C22B 34/10

[52] U.S. Cl. ..... 423/69; 423/86; 423/82; 423/74

[58] Field of Search ..... 423/86, 82, 74, 423/69

[56] References Cited

U.S. PATENT DOCUMENTS

| | | | |
|---|---|---|---|
| 2,961,298 | 11/1960 | Tikkanen | 423/86 |
| 3,060,002 | 10/1962 | Leddy et al. . | |
| 3,291,599 | 12/1966 | Reeves . | |
| 3,457,037 | 7/1969 | Aramendia et al. | 423/86 |
| 3,868,441 | 2/1975 | Agee et al. | 423/82 |
| 3,875,286 | 4/1975 | Robinson et al. | 423/86 |
| 3,897,537 | 7/1975 | Robinson et al. | 423/86 |
| 3,922,164 | 11/1975 | Reid et al. | 423/86 |
| 4,038,364 | 7/1977 | Lailach | 423/86 |
| 4,097,574 | 6/1978 | Auger et al. | 423/86 |
| 4,120,694 | 10/1978 | Elger et al. | 423/82 |
| 4,199,552 | 4/1980 | Rado | 423/86 |
| 4,933,153 | 6/1990 | Gueguin | 423/82 |
| 5,011,666 | 4/1991 | Chao et al. | 423/82 |
| 5,063,032 | 11/1991 | Gueguin | 423/82 |
| 5,389,355 | 2/1995 | Gueguin | 423/82 |

FOREIGN PATENT DOCUMENTS

| | | | |
|---|---|---|---|
| 247110 | 9/1963 | Australia . | |
| 69483/74 | 10/1976 | Australia . | |
| 26 109/77 | 12/1978 | Australia . | |
| 767560 | 9/1967 | Canada | 423/86 |
| 2038191 | 2/1971 | Germany . | |
| 2038248 | 2/1971 | Germany . | |
| 2425394 | 12/1974 | Germany | 423/82 |
| 70/5322 | 7/1970 | South Africa . | |
| 77/3543 | 6/1977 | South Africa . | |
| 94/3488 | 5/1994 | South Africa . | |
| 1092034 | 11/1967 | United Kingdom . | |
| 1225826 | 3/1971 | United Kingdom . | |
| 1282506 | 7/1972 | United Kingdom | 423/82 |
| 1477840 | 6/1977 | United Kingdom | 423/86 |
| WO 94/04709 | 3/1994 | WIPO . | |

*Primary Examiner*—Steven Bos
*Attorney, Agent, or Firm*—Nilles & Nilles

[57] ABSTRACT

A method is disclosed including: (a) sizing a titania slag to a particle size range of from 75 microns to 850 microns; (b) oxidizing the sized titania slag by contacting the sized titania slag with an oxygen containing gas at a temperature of at least about 950° C. for a period of at least about 20 minutes such that a substantial portion of the iron oxide is converted to a ferric state, such that the reduced titanium oxides are converted to a tetravalent state, and such that at least a major portion of the glassy silicate phase is decomposed; (c) reducing the oxidized titania slag in a reducing atmosphere at a temperature of at least about 700° C. for a period of at least about 30 minutes such that the ferric state iron oxide is converted to a ferrous state; (d) leaching the reduced titania slag with mineral acid at a temperature of at least 125° C. and under a pressure in excess of atmospheric pressure to yield an upgraded leached slag product and a leachate; and (e) washing and calcining the upgraded leached slag product by heating at a temperature in the range of from 600° C. to 800° C. The method provides advantages in that it can be used to produce a product with high $TiO_2$ content that is suitable for the chloride process of $TiO_2$ pigment production.

36 Claims, 2 Drawing Sheets

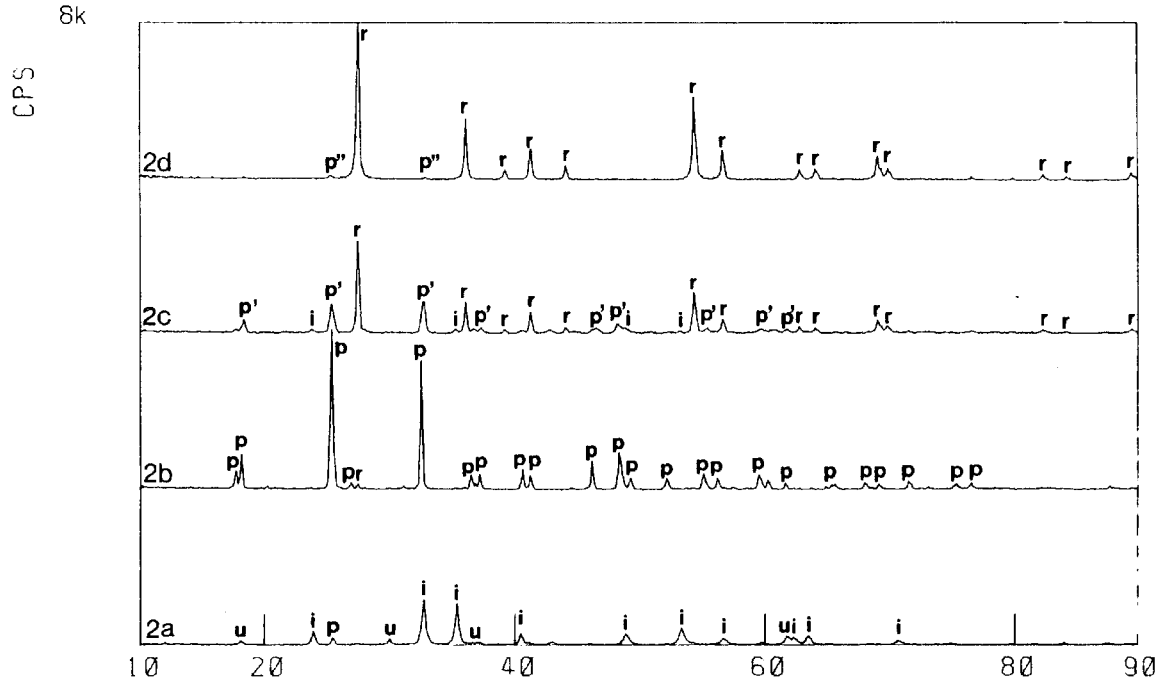
Figure 2 - X-ray diffraction patterns of roasted Allard Lake ilmenite ore (2a), Sorelslag (2b), oxidized/reduced Sorelslag (2c) and UGS product (2d).
i - ilmenite, u-ulvospinel, p-ferrous pseudobrookite, r-rutile, p'-MgO deficient pseudobrookite free of $Ti_3O_5$, p "-residual pseudobrookite in UGS product.

METHOD TO UPGRADE TITANIA SLAG AND RESULTING PRODUCT

BACKGROUND OF THE INVENTION

1. Field of the Invention

This invention relates to a method of preparing a high grade titanium dioxide ($TiO_2$) product from titania slags by removing alkaline earth and other impurities usually found in slags. The method of the present invention generally comprises the steps consisting of sizing the slag, oxidizing it at high temperature, reducing the resulting material at high temperature, subsequently acid leaching the reduced material at elevated temperature and pressure to yield an upgraded slag product and a leachate, and finally calcining the leached product. The upgraded slag obtained from the inventive method is a suitable feedstock for the chloride process of $TiO_2$ pigment production.

Optionally, the upgrading process may also comprise a caustic leaching step performed immediately after the acid leaching step. The caustic leaching step will be particularly useful to remove residual $SiO_2$ in the upgraded product.

2. Description of the Prior Art

Titanium Feedstocks for $TiO_2$ Pigment Production

The present invention is directed to a process for the upgrading of titania slags into a product having a very high $TiO_2$ content with low levels of alkaline-earth and other impurities.

Titanium is the ninth most abundant element in the earth's crust. Of the various titanium based products, titanium dioxide ($TiO_2$), holds the greatest industrial and commercial significance. It is a high-volume chemical in most of the industrialized world. Titanium dioxide is used as pigment in paints, plastics, papers, inks, etc.

Titanium dioxide ($TiO_2$)is commonly found in nature in the form of "ilmenite" ores containing from 30 to 65% $TiO_2$ in association with varying amounts of oxide impurities of the elements iron, manganese, chromium, vanadium, magnesium, calcium, silicon, aluminum and others. Ilmenite ores are commercially upgraded into titania "slag" containing typically 70–90wt % $TiO_2$ by electro-smelting processes conducted at very high temperatures (molten state) in electric arc furnaces. Ilmenite ores are also upgraded into "synthetic rutile" products containing 92–95wt % $TiO_2$ by processes consisting in the "leaching" of ilmenite ores with mineral acids or in reducing the iron oxide impurities in the presence of coal at moderately high temperatures (solid state reduction) in rotary kiln type furnaces. "Rutile" is a still richer form of $TiO_2$ (93–96% $TiO_2$) which occurs naturally but is rarely found in deposits of commercial significance.

The production of $TiO_2$ pigments is based on two processes. The traditional "sulfate" process consists in solubilizing ilmenite or slag by dissolving it in concentrated sulphuric acid; pure $TiO_2$ is then obtained by selective hydrolysis of the liquors containing the solubilized $TiO_2$. In the newer "chloride" process, a feedstock such as ilmenite, slag, synthetic rutile or natural rutile is fluidized at high temperature (typically 950°–1200° C.) in a stream of chlorine gas to produce a vapour mix of chlorides, including $TiCl_4$ and the chlorides of the feedstock impurities; $TiCl_4$ is separated from the impurity chlorides by selective condensation and is subsequently converted to pure $TiO_2$ by contacting it with oxygen at high temperatures (chlorine gas is recovered in the oxidation treatment).

The main technical requirement for sulfate process feedstocks is that these must be soluble in concentrated sulphuric acid. For the chloride process, however, the main technical requirements are: i) the feedstock must contain low concentrations of alkaline-earth oxides such as MgO and CaO, and ii) the particle size range must be compatible with the fluid bed equipment used to chlorinate the feedstock. In addition, environmental and economic considerations dictate the need for the highest possible $TiO_2$ contents in the feedstock.

The present invention relates specifically to the preparation of a high grade $TiO_2$ feedstock suitable for the fast growing chloride pigment process by upgrading titania slags. The initial slag can be naturally low in alkaline-earth oxide impurities, such as the slag produced from ilmenite ores mined in the East Coast of the Republic of South Africa, or could contain higher levels of these impurities, as is the case of slag produced from ilmenite ores mined in the Province of Quebec, Canada. In both cases the resulting upgraded product is of similar $TiO_2$ contents (typically 94–96% $TiO_2$) and exhibit contents of alkaline-earth oxides well below the maxima generally acceptable for chloride feedstocks (1.50% MgO and 0.20% CaO). This is an important aspect of the invention since the use of slags containing higher levels of alkaline-earth oxides has been up to now restricted to the sulfate pigment process.

Oxides of the alkaline earth metals such as MgO and CaO are undesirable in the chloride pigment process as they form during chlorination paste-like condensates of $MgCl_2$ and $CaCl_2$ which tend to foul the fluidizing reactors and other downstream equipment. However, alkaline-earth oxides are commonly found in magmatic $TiO_2$-bearing deposits known as rock ilmenites which represent the most abundant sources of $TiO_2$. Rock ilmenites, being relatively low in $TiO_2$ contents (30–45% $TiO_2$) but containing high concentration of iron oxides, can only be economically upgraded by electro-smelting processes which produce a titania slag and recover the iron values in the form of high purity iron products, the latter feature not being possible in other commercial ilmenite upgrading processes. While electro-smelting of rock ilmenites renders the resulting slag suitable as a feedstock for the sulfate process, the smelting does not remove sufficient amounts of impurities, such as alkaline-earth impurities, including magnesium and calcium, to make the slag suitable as a feedstock for the chloride process.

There is therefore a need to provide a commercially attractive method for further upgrading slags obtained from ilmenites, including those ilmenites naturally high in alkaline-earth impurities, to yield a suitable high grade feedstock for the chloride process of $TiO_2$ production.

Unexpectedly, it has been discovered that titania slags can be treated in a novel and commercially efficient process to produce an upgraded slag product which is an excellent feedstock for the chloride process.

Differences between slags and ilmenites

The literature contains a number of prior art processes aimed at the upgrading of ilmenite ores into synthetic rutile type products by applying mineral acid leaching techniques.

These processes are not applicable to the upgrading of titania slag because of the vastly different chemical and physical nature of ilmenite ores and titania slags. As will be shown in the figures which form part of this application, it is manifest that the X-ray diffraction patterns of ilmenite ores and slags are quite different indicating that their chemical and physical properties are also quite different. What follows is a description of the chemical and physical differences separating ilmenite ores from titania slags.

Ilmenite ores are found in nature as primary ilmenites ($FeTiO_3$) or weathered ilmenites and mixtures thereof. Weathered ilmenites result from oxidation by ground water which gradually transforms primary ilmenites through the following major phases: pseudorutile ($Fe_{2.3}Ti_3O_9$), altered pseudorutile ($Fe_{1.2}Ti_3O_{6.6}(OH)_{2.4}$), leucoxene ($Fe_{0.6}Ti_3O_{4.8}(OH)_{4.2}$) and finally natural rutile ($TiO_2$). The prior art has evolved various processes for upgrading ilmenites (primary, secondary and mixtures thereof) to synthetic rutile by concentrating the $TiO_2$ content and removing iron as well as various gangue minerals and other impurities by mineral acid leaching processes. These prior art processes, which will be discussed in greater detail below, are usually adapted for use with ilmenites and do not yield satisfactory results with titania slags mainly because slags are physically and chemically different from ilmenites.

Titania slags are generally produced by reduction smelting of ilmenite ores in an electric arc furnace. The resulting slags consist of two main phases:

(i) an abundant pseudobrookite phase which can be described as a solid solution of different titanates and whose general formula is as follows:

$$(FeTi_2O_5)_a(MgTi_2O_5)_b(Al_2TiO_5)_c(MnTi_2O_5)_d(V_2TiO_5)_e(Ti_3O_5)_f$$

wherein a+b+c+d+e+f=1.

Such crystallographic phase is not known to occur naturally in the earth's crust, although a similar crystalline association known as armalcolite has been found in lunar rocks brought back by the Apollo missions.

As an example, the pseudo-brookite phase constituting the bulk of the commercially available SORELSLAG™ can be described by the following formula:

$$(FeTi_2O_5)_{0.31}(MgTi_2O_5)_{0.30}(Al_2TiO_5)_{0.06}(MnTi_2O_5)_{0.008}(V_2TiO_5)_{0.012}(Ti_3O_5)_{0.31}$$

Such phase contains practically all of the titanium found in the slag and most of the iron, magnesium, manganese, vanadium and certain other impurities found in the slag.

A notable feature of this phase is its inherent inertness toward the action of mineral acids relative to titanium-bearing phases present in ilmenite ores. Such inertness renders the slag very difficult to upgrade by acid leaching processes, unless its structure is substantially converted into formations more amenable to the leaching action of such acids.

(ii) a minor glassy silicate phase is present in the form of inclusions, attachments and veins inside the pseudobrookite phase. The general formula is as follows:

$$(Ca,Al,Mg,Fe,Ti)SiO_3.$$

A typical chemical composition of this glassy silicate phase is as follows when expressed in % wt:

| $SiO_2$ | $Al_2O_3$ | CaO | MgO | FeO | $TiO_2$ |
|---|---|---|---|---|---|
| ~60 | 18–20 | 9–10 | 1–4 | 2–4 | 3–4 |

It is observed that most of the CaO impurity is concentrated in this glassy silicate phase which is rather impervious to leaching. The CaO content is a tenacious alkaline-earth impurity which must be removed or at least significantly reduced if it is hoped to produce an upgraded slag product suitable for the chloride pigment process. Thus, it is important to find a way to decompose this glassy silicate phase to free the CaO for subsequent leaching.

It is noted that such glassy silicate phases are characteristic of titania slag and are generally absent in ilmenite ores. Furthermore, the prior art does not teach any efficient means for the physical separation of the glassy silicate from slags.

From a physical point of view, titania slags are produced in the molten state and are usually cast in ladles or similar equipment to produce solid blocks ranging in weight from a few tons to 30–40 tons. This contrasts with ilmenite ores, used for the production of synthetic rutile by acid leaching processes, whose natural grain size is typically in the 75–250 micron range. It follows that titania slag must be initially sized by means of crushing, screening and classification technologies prior to subjecting it to an upgrading process.

It should be noted that the slag sizing process offers an opportunity to tailor the size distribution of the feedstock to the optimum requirements of the chloride pigment process. In the present invention, the initial titania slag is preferably sized between 75 and 850 microns with a mean particle diameter ($^d50$) in the range of 250–350 microns. It has been found that such size distribution enhances the productivity of the fluid bed chlorination reactors while reducing the process losses due to entrainment of very fine particles in the stream of gaseous chlorides produced in the reactors.

In summary, a process for the upgrading of titania slag will differ from prior art processes for the upgrading of ilmenite ores, inter alia, in the following regards:

i) sizing of the slag is required;

ii) extensive modification of the titanium-bearing pseudobrookite phase of the slag is required to facilitate the action of mineral acids for the removal of impurities such as iron, magnesium, manganese, vanadium, aluminum and others;

iii) extensive modification of the calcium-bearing glassy silicate phase of the slag is required to facilitate the removal of calcium if such element is present in excess of the levels that are tolerable in the chloride pigment process.

iv) acid leaching of the slag is conducted under specified conditions of temperature, pressure, acid concentration, time and other process variables.

Prior Art Processes

The literature contains a number of processes to upgrade titania slags into high $TiO_2$ products suitable as feedstocks for the chloride process of pigment production. Thus, Guéguin in U.S. Pat. Nos. 4,933,153, 5,389,355 and 5,063,032 proposes to:

i) partly upgrade the slag by contacting it with chlorine gas at moderate to high temperatures, and ii) subsequently leach the partly upgraded product with hydrochloric acid in pressure vessels.

In U.S. Pat. No. 4,629,607, Guéguin also discloses a method consisting in the partial chlorination of pre-heated slag which does not include a subsequent acid leaching step. Such method is not effective in removing alkaline-earths impurities and its application is therefore more useful for the upgrading of slags naturally low in these types of impurities.

U.S. Pat. Nos. 4,120,694 and 4,362,557 (Elger et al.) disclose processes for the removal of MgO and CaO impurities from finely ground and pelletized titania slag by sulfonation roasting using $SO_3$ at a temperature range of 600°–1000° C. in order to form a more easily removable double sulfate , i.e. $CaSO_4*3MgSO_4$. Sulfonation promoters such as sodium salts are also proposed. However, the processes require much time (upwards of 20 hours) to sufficiently reduce the MgO and CaO content for its intended use and do not efficiently remove other impurities, generally yielding a product which must undergo further treatment prior to use as a feedstock in the chloride process of $TiO_2$ production.

In contrast to the above disclosures, the process disclosed herein achieves the necessary modification of the slag structure by means of simpler treatments consisting in the sequential oxidation and reduction of the slag conducted under specified thermodynamic and retention time conditions. The treated slag is then subjected to an acid leaching step conducted under practical conditions of temperature, pressure and contact time.

The prior art also proposes various other processes which may include acid leaching steps but which are specific to the upgrading of ilmenite ores. Indeed, these processes are mostly directed to the removal of the iron oxide impurities, since other impurities, notably MgO and CaO, but also others such as $Al_2O_3$, $V_2O_5$, etc. are generally absent or present in small concentrations in the ilmenite ores which are the object of the prior art disclosures. In addition, the prior art processes are designed to deal with mineralogical structures which are substantially more amenable to the leaching action of mineral acids than those found in titania slags. It is noteworthy that some of these prior art processes include certain unit operations which resemble certain portions of the present disclosure. However, as will be illustrated later by the way of examples, when these prior art processes are applied to titania slags, they fail to produce the results obtained by applying the process of the present invention.

For example, Sinha et al. describe in G.B. patent No. 1,225,826 a process for the upgrading of ilmenite ores which includes thermal treatments of oxidation and reduction generically similar to those described in the present disclosure but which are conducted under conditions of temperature and retention time that are inadequate for the successful modification of the mineralogical structure of slags. Similarly, the leaching step included in the G.B. patent No. 1,225,826 is conducted at or nearly atmospheric pressure, a condition that has been shown to be insufficient when applied to slags.

U.S. Pat. No. 3,825,419, Chen, assigned to the Benilite Corporation of America, describes yet another process for the upgrading of ilmenite which includes relatively mild oxidation and reduction treatments conducted in kiln-type furnaces and mostly aimed at reducing the trivalent iron ions to divalent ones as the trivalent iron is undesirable for the subsequent leaching of the ilmenite ore. Again, the process conditions described in this patent are inadequate for the object of modifying the structure of slags.

U.S. Pat. No. 4,199,552, Rado, describes another process for the upgrading of ilmenite ore which includes, sequentially, reduction of the ore to convert trivalent iron to bivalent iron and some metallic iron, and oxidation of the reduced ore to convert the metallic iron to bivalent iron without excessive production of trivalent iron, followed by acid leaching. Again, the process conditions described in this patent are inadequate for the object of modifying the structure of slags.

What can be learned from the prior art discussed above is that there are numerous known approaches for beneficiating ilmenite ores which may comprise oxidation, reduction or leaching steps to leach out impurities and concentrate the $TiO_2$ content of the ore. In such processes, the iron content of the ilmenite is generally separated from the titanium by dissolving the iron as a soluble salt of the acid. However, such processes do not work with titania slag which is substantially more inert to the leaching action of mineral acids because of its high pseudobrookite content and because of its glassy silicate content. In particular, it has been observed that most of the MgO is contained in the pseudobrookite phase and that most of the CaO is found in a glassy silicate from both of which these alkaline-earth metal oxide impurities are very difficult to leach under practical conditions of pressure and temperature. Consequently, the prior art processes for upgrading ilmenites to synthetic rutile fail to address the difficulties surrounding the removal of impurities from slag.

Indeed, it has been discovered that titania slag requires a pretreatment within an unexpected window of process conditions to render it suitable for acid leaching. The pretreatment of the present invention achieves a surprising phase change in the particle structure of the slag which greatly facilitates the subsequent leaching step. Indeed, in accordance with the present invention, the very difficult to leach pseudobrookite phase of the slag is in major part shifted to a more easily leachable ilmenite-geikielite solid solution created during the process which exhibits a marked tendency to concentrate the MgO impurity. Meanwhile, the CaO impurity concentrated in the glassy silicate phase is also freed for ease of leaching by a decomposition of the glassy silicate phase.

It is therefore the primary object of the present invention to provide an efficient and economically feasible process to upgrade titania slag into a high grade product suitable for the chloride process of pigment production.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

SUMMARY OF THE INVENTION

The process of the present invention is therefore aimed at concentrating the $TiO_2$ content and removing impurities from a titania slag. Another way to generally describe the inventive process is a method to upgrade titania slag by effecting a pretreatment on the slag to provide an intermediate product which is more easily leached of its impurities.

In general terms, the present invention provides a method to upgrade titania slags to obtain a high $TiO_2$-containing product having residual impurity content and grain size distribution suitable for use as a feedstock in the chloride process of titanium dioxide pigment production, said titania slag containing impurities in the form of oxides of the elements iron, manganese, chromium, vanadium, aluminum, silicon, alkaline-earths and others distributed in a pseudobrookite phase and a glassy silicate phase, the method comprising:

(a) sizing the titania slag such that the size of individual slag particles are in the 75 to 850 micron range, preferably having a mean particle diameter of about 250–350 microns;

(b) oxidizing the sized slag by contacting the slag with an oxygen containing gas at a temperature of at least about 950° C. for a period of at least about 20 minutes such that a substantial portion of the iron oxides are converted to the ferric state, such that the reduced titanium oxides are converted to the tetravalent state, and such that at least a major portion of the glassy silicate phase is decomposed;

c) reducing the oxidized slag in a reducing atmosphere at a temperature of at least about 700° C. for a period of at least about 30 minutes such that the ferric state iron oxides are converted to the ferrous state;

(d) mineral acid leaching of resulting treated slag at a temperature of at least 125° C. and under a pressure in excess of atmospheric pressure to yield an upgraded leached slag product and a leachate;

(e) washing and calcining the upgraded leached product by heating such product at 600° C. to 800° C.

The method of the present invention thus eliminates most of the impurities contained in the original slag, including the alkaline-earth metal oxides, with minimal loss of titanium values and degradation of the size of the grains. Preferably, the upgraded slag product will contain at least 90% wt of titanium dioxide and less than 1% wt of magnesium oxide and less than 0.2% wt of calcium oxide.

It is also important to note that during the treatment steps (b) and (c), the MgO content of the slag tends to migrate to an ilmenite-geikielite phase from which it is clearly easier to leach-out the MgO. Furthermore, during oxidation step (b), the CaO, which was initially trapped in the glassy silicate phase is liberated by the decomposition of the glassy silicate.

In an optional embodiment, the method of the present invention also comprises a caustic leaching step performed after acid leaching step d) and prior to calcination step e).

The present invention provides a novel product particularly suitable for use as a feed material for the chloride process of pigment production.

Also in an optional embodiment, the method of the present invention may be abbreviated to steps a) to c), inclusively. The resulting intermediate product may be sold and used for further processing by eventual purchasers.

BRIEF DESCRIPTION OF THE DRAWINGS

Preferred embodiments of the invention will now be described by way of example only and with reference to the accompanying drawings wherein:

FIG. 2*a* is an x-ray diffraction pattern of rock ilmenite ore from Allard Lake, Province of Québec;

FIG. 2*b* is an x-ray diffraction pattern of a typical slag prepared by electro-smelting and commercialized under the name SORELSLAG™;

FIG. 2*c* is an x-ray diffraction pattern of the intermediate product obtained by subjecting the slag to the oxidation and reduction treatments under the conditions herein disclosed.

FIG. 2*d* is an x-ray diffraction pattern of upgraded slag produced in accordance with the present invention.

DETAILED DESCRIPTION OF THE INVENTION

Figure 1:
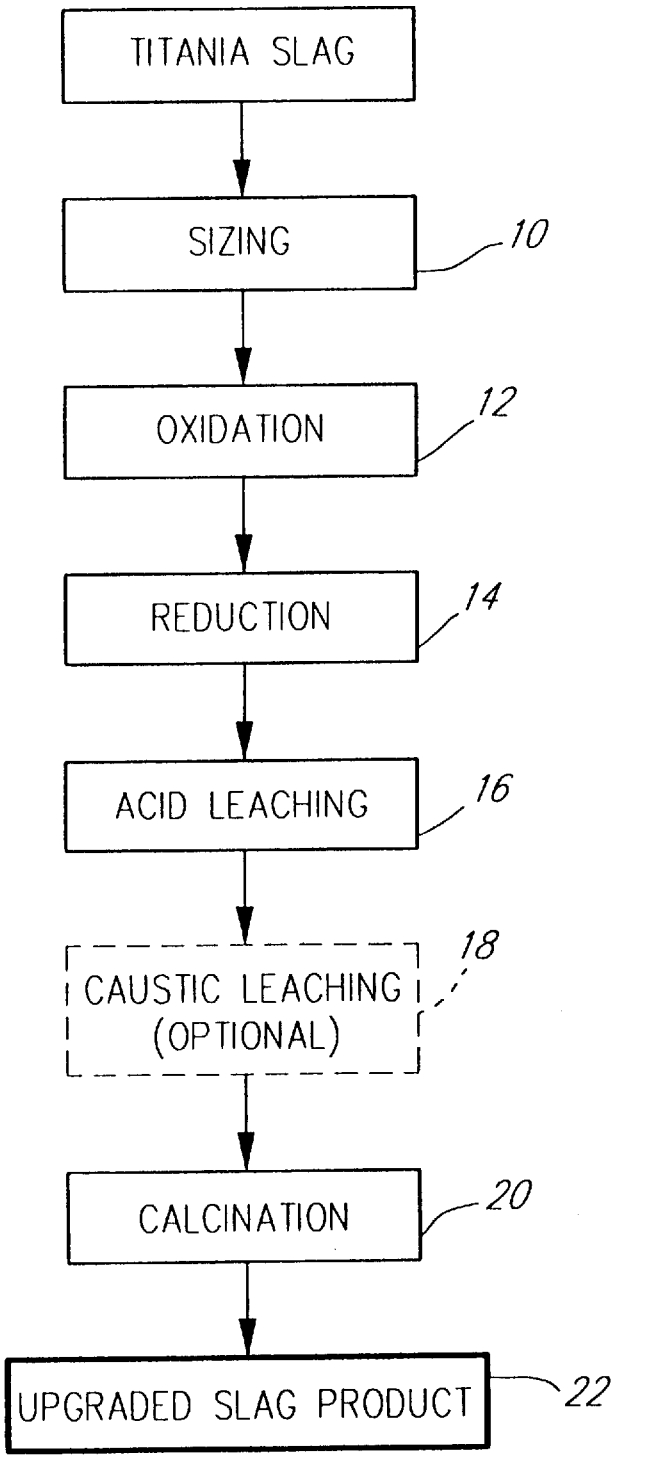
FIG. 1 is a simplified flowchart of the method of the present invention.

The process of the invention comprises five basic and general steps, namely:

i. sizing of the slag;

ii. oxidation of the sized slag;

iii. reduction of the oxidated slag;

iv. mineral acid leach of the oxidized/reduced titania slag to yield an upgraded product and a leachate; and v. calcination of the upgraded product.

The process may also comprise an optional caustic leaching step immediately after step iv and prior to step V.

The product of such process will then be a particularly high $TiO_2$ product with acceptable low levels of all impurities contained therein and which may be used for production of $TiO_2$ pigment by the chloride process.

The starting material used in the method of this invention is a titania slag typically containing iron oxides and alkaline-earth metal oxide impurities and other impurities such as manganese, aluminum, vanadium and chromium values. "Alkaline-earth metals" are those elements that form group IIA of the periodic table of elements, e.g. magnesium, calcium, strontium and barium.

The method of this invention is particularly suited for the upgrading of slags containing magnesium and calcium oxides near to, or in excess of, the maximum levels tolerable by the chloride pigment process, about 1.5% and 0.20% respectively.

A characteristic of titania slags is that at least some portion of its titanium values is found in the trivalent state as reduced titanium oxide $Ti_2O_3$. Such titania slag after solidification consists of a pseudobrookite solid solution as the major constituent phase and a minor amount of glassy silicate. Typically, titania slags will contain 90–95% wt pseudobrookite and 5–10% wt glassy silicate and in some cases other minor constituents. The MgO impurity is mostly present in the pseudobrookite phase and CaO as another impurity mainly present in the glassy silicate phase.

Referring now to FIG. 1, it is seen that the method of the present invention comprises five main steps and an optional step which will now be described in further detail.

Step 1

Shown in FIG. 1 as numeral 10, this step consists in the sizing of the slag by grinding, screening and classifying using conventional equipment. The slag is sized in the 75–850 micron range with a mean particle size preferably between 250 and 350 microns.

Step 2

The second step shown on FIG. 1 as numeral 12, is an oxidation (also known as rutilization) of the slag by contacting said slag with an oxidizing agent at an elevated temperature of at least about 950° C., preferably about 1025° C. and preferably not exceeding 1100° C. To assure the even exposure of the slag particles to the oxidizing gas, a fluid-bed reactor configuration is preferred. Optionally, the slag may be preheated. During oxidation, retention times of 20 minutes to 2 hours are sufficient to convert the Ti+3 values to Ti+4 and ferrous iron oxide (Fe+2) to ferric iron oxide (Fe+3) but the optimum time within this range varies according to the particular slag being treated.

The oxidation agent will preferably be an oxygen containing gas. In a preferred embodiment, a gas containing at least 2% vol. of oxygen and preferably 6% vol. of oxygen is fed to the fluid-bed reactor. Such gas may, for example, result from the combustion of a solid, liquid or gaseous fuel.

The oxidation of titania slag can be balanced by the following equation for the major pseudobrookite phase (for simplicity, only major solid solution constituents have been considered):

$$(FeTi_2O_5)_x(Mg\,Ti_2O_5)_y(Ti_3O_5)_{1-x-y}+[(2-x-2y)/4]O_2=(Fe_2TiO_5)_{x/2}(MgTi_2O_5)_y+3(1\tfrac{1}{2}x-y)TiO_2$$

wherein the value of x and y will depend on the slag material used.

As an illustrative example, for SORELSLAG™, the equation when applied would approximately provide:

$$(FeTi_2O_5)_{0.32}(MgTi_2O_5)_{0.33}(Ti_3O_5)_{0.35}+0.255O_2=(Fe_2TiO_5)_{0.16}(MgTi_2O_5)_{0.33}+1.53TiO_2$$

It is noteworthy that the oxidation of slag results in a major rutile ($TiO_2$) phase (rutilization). Such a process if applied to ilmenite ore would not yield a similar product. Furthermore, it has been discovered that during the oxidation of slag, the glassy silicate phase of the slag is decomposed which later facilitates leaching out the CaO impurity which was mainly present in the glassy silicate phase.

Indeed, the glassy silicate phase appears to be decomposed mainly into $CaSiO_3$ (wollastonite) and $SiO_2$ (tridymite) which facilitates the subsequent removal of CaO by leaching. The decomposition of the glassy silicate phase appears to be triggered by the oxidation of FeO contained in the glassy silicate and can be shown in the following simplified equation:

$$(Ca,Al,Mg,Fe.Ti)Si0_3+O_2 \rightarrow Fe_2O_3+CaSiO_3+SiO_2+Al_2SiO_5+TiO_2$$

It has also been discovered that during the oxidation a fast diffusion of iron and titanium cations occurs within the pseudobrookite phase resulting in the formation of a large number of small pores and channels in each grain of slag. The iron cations tend to concentrate around these pores and channels which will render them more accessible for leaching. Thus, this increased porosity and radically changed crystal structure facilitates the subsequent reduction and leaching steps.

Hence, the above described oxidation parameters, temperatures, retention times, and oxidizing agents were discovered to result in an extensive rutilization and in a rather complete transformation of the ferrous oxide to ferric oxide contained in a ferric pseudobrookite solution and at the same time in the decomposition of the glassy silicate phase.

Furthermore, it has been observed that the grain size distribution of the slag does not change appreciably during the oxidation step.

Step 3

The next step shown on FIG. 1 as numeral 14, is a reduction step also preferably conducted in a fluidized-bed reactor. This reduction step is accomplished by contacting the oxidized slag with a reducing agent at an elevated temperature of at least about 700° C., preferably in the range of about 800°–850° C. and preferably not exceeding 900° C. The preferred retention time in the reactor vessel is at least 20 minutes and preferably between 1 to 2 hours.

The reducing agent will be advantageously selected from the following, carbon monoxide gas, hydrogen gas, mixtures thereof such as smelter gas or reformed natural gas and coal fines, although other reduction agents are known to those skilled in the art. In a preferred embodiment, a smelter gas containing about 85% CO and 15% $H_2$ is fed to the fluid-bed reactor. In general, the oxygen partial pressure in the reducing atmosphere can be varied to convenience, but is preferably below $10^{-2}$ atm to minimize the formation of metallic iron. In addition, it may be useful to add minor amounts of water vapor or carbon dioxide to the reduction gas in order to control the oxygen partial pressure during the reduction step.

Reduction of the oxidized slag appears to take place in two stages. In the initial stage, the ferric state ($Fe^{3+}$) iron oxide contained in the pseudobrookite phase is reconverted to ferrous state ($Fe^{2+}$) iron oxide. The pseudobrookite phase is already freed of $Ti^{3+}$ constituents which where oxidized during the oxidation step and removed of the pseudobrookite phase as rutile ($TiO_2$).

In a second stage, there is observed a solid state reaction resulting in radical changes in the crystal structure of the slag. Indeed, there is observed the formation of an MgO-enriched ilmenite-geikielite solid solution, a consequently MgO-deficient residual pseudobrookite phase and a rutile phase. Hence, the MgO is seen to migrate to the ilmenite-geikielite solid solution, which is fortunately easier to leach than the pseudobrookite. However, during the oxidation and the reduction steps, even the residual pseudobrookite phase becomes less impervious to leaching by reason of the creation of a large number of pores, channels and other defects in the crystal lattice.

After steps 2 and 3, namely oxidation and reduction treatment of the slag, the treated slag consists of rutile, MgO-deficient pseudobrookite, MgO-enriched ilmenite-geikielite solid solution and decomposed glassy silicate. For example, in the case of SORELSLAG™, the treated slag consists typically of about 65–70% rutile, 20–25% pseudobrookite, 5–10% ilmenite-geikielite and 3–5% decomposed glassy silicate. Because of steps 2 and 3, the subsequent leaching step will proceed at enhanced rates on all phases.

After steps 1 to 3 are performed, the intermediate product is sufficiently stable to be stored or transported to another location for further processing.

Step 4

The treated slag is then cooled and mixed with hydrochloric acid in a suitable pressure vessel under elevated temperature and pressure to leach away impurities and provide an upgraded product and a leachate as shown in FIG. 1 as numeral 16. The amount of acid used must be sufficient to combine with the impurities to form soluble chlorides and is preferably at least about 10% wt and most preferably 20% wt in excess of stoichiometric requirements. The strength of the acid can vary to convenience but is preferably at least 15% wt and most preferably about 18 to 20% wt.

The temperature at which the treated slag and hydrochloric acid are mixed is an elevated temperature, i.e., above the boiling point of the acid at atmospheric pressure. Temperatures of at least 125° C. are preferred and about 145° to 155° C., most preferred.

Pressure relates to temperature inside the leaching vessel and can vary widely. Typically, the pressure developed from the water vapour and hydrogen chloride is in the range between 10 psig and 80 psig, with a range of 40–70 psig occurring frequently. Most preferred are temperatures of about 145 to 155° C. and a resulting pressure of about 50–70 psig.

The required contact time between the treated slag and hydrochloric acid will vary with the conditions and especially with the concentration of the acid and the temperature and pressure used. The treated slag and hydrochloric acid are contacted for a sufficient period of time to allow a thorough leaching of the impurities from the treated slag grains, generally not less than 2 hours but preferably 5 to 7 hours.

In a preferred embodiment the leaching may be performed in a two stage process. In the first stage, the treated slag is charged into a leaching vessel containing about one half of the total requirements of 18 to 20 wt % hydrochloric acid solution. The mixture is heated to a temperature of about 150° C. and maintained at the developed pressure for a sufficient period of time. The leachate solution is then pumped out leaving a partly leached slag in the vessel. A similar quantity of fresh acid solution is introduced and leaching takes place as in the first stage.

One skilled in the art would also immediately recognize that the leaching step can also be completed in single stage or in three or more stages. Likewise, it is obvious that although the preferred embodiment comprises the use of fresh hydrochloric acid, it is possible to use mixtures of fresh acid solution and recycled first or second stage leachate.

While the preferred embodiment has been described as a process with hydrochloric acid as leachant, it has been found that the leaching step may be performed with other mineral acids such as, for example, 30–35 wt % sulphuric acid ($H_2SO_4$) or mixtures of hydrochloric and sulphuric acid.

Step 5

This is the step involving recovery of the upgraded product and is shown on FIG. 1 as numeral 20. After step 4, the upgraded leached product is cooled and depressurized and after separation from the leach liquor, is washed and calcined at a temperature of from about 600° C. to about 800° C. to remove moisture and residual acid. The resulting upgraded slag product 22 is a granular product containing in excess of 90 wt % and preferably 93 to 95% wt of $TiO_2$ and less than 1.5 wt % of $Fe_2O_3$, less than 1% each MgO and $Al_2O_3$ and less than 0.2 wt % of CaO.

Caustic leach

In an optional embodiment, the process of the present invention may also comprise a caustic leaching operation 18 performed after acid leaching and washing but before calcination The main object of this caustic leaching step is to remove excess $SiO_2$ that may be remaining in the upgraded slag. The caustic leaching step is preferably performed at a temperature of at least about 50° C. and under agitation. Again preferably, the leaching will be performed in a counter-current, multi-stage leaching apparatus using sodium hydroxide as the leaching fluid. The duration of leaching and/or other leaching conditions will be readily ascertained by those skilled in the art.

It is to be understood that all steps described above may be conducted in either a batch or continuous mode. It is also noteworthy that the product of the process possesses a suitable particle size distribution for use as a feedstock in the titanium chloride process.

Examples of Preferred Embodiments

The following are illustrative examples, which are set forth by way of illustration and not as limitations.

Example 1

As a starting material for the process of the present invention, a sample of SORELSLAG™ was obtained from the electro-smelting of rock type ilmenite from Allard Lake, located on the upper North shore of the St-Lawrence river in Quebec, Canada. The smelting was conducted in a large scale electric arc furnace and the issuing slag was solidified and sized in the 75–850 micron range. The sized slag used as a starting material had the composition presented in Table 1 below.

TABLE 1

| SORELSLAG ™ Composition (wt %) | | | | | | | | |
|---|---|---|---|---|---|---|---|---|
| $TiO_2$* | $Fe_t$ | $Al_2O_3$ | CaO | MgO | MnO | $SiO_2$ | $Cr_2O_3$ | $V_2O_5$ |
| 82.55 | 6.35 | 2.98 | 0.47 | 5.56 | 0.26 | 2.09 | 0.18 | 0.63 |

(*total Ti reported as $TiO_2$, regardless of valence state)
("t" refers to total iron content regardless of valence state)

The slag was oxidized in solid state with air at 1000° C. for 45 mins and then reduced at 800° C. for 1 hour with smelter gas containing 85% CO and 15% $H_2$ by volume. The treated slag was subsequently cooled and leached in a two stage procedure at 145° C. with 20 wt % hydrochloric acid solution used in a stoichiometric excess of 20%, based on the stoichiometrical quantity required for the removal of the acid leachable constituents of the slag. In the first leaching stage the slag was contacted for 3.5 hr with 53% vol. of the total amount of hydrochloric solution. The first stage leachate was decanted. The treated slag was then contacted again with the remaining 47% vol. of the 20 wt % hydrochloric acid solution for an additional 2.5 hr. The second stage leachate was also decanted and the leached solid fraction was washed in water, calcined and analysed using conventional analysis techniques. The composition of the resulting upgraded slag product after washing and calcination is presented in Table 2 below:

TABLE 2

| Upgraded Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 94.31 | 0.68 | 0.71 | 0.17 | 0.6 | 0.03 | 2.67 | 0.02 | 0.3 |

Example 2

SORELSLAG™ produced by electro-smelting of Allard Lake ilmenite in an arc furnace showed the composition presented below in Table 3.

TABLE 3

| SORELSLAG ™ slag composition (wt %) | | | | | | | | |
|---|---|---|---|---|---|---|---|---|
| $TiO_2$* | $Fe_t$ | $Al_2O_3$ | CaO | MgO | MnO | $SiO_2$ | $Cr_2O_3$ | $V_2O_5$ |
| 84.8 | 3.76 | 3.62 | 0.47 | 5.89 | 0.26 | 3.06 | 0.027 | 0.65 |

(*total Ti reported as $TiO_2$, regardless of valence state)

The slag was sized by grinding and screening at 75–850 microns and was subsequently oxidized in solid state with air at 1000° C. for 1 hour, and was then reduced at 800° C. for 1 hour with smelter gas having the same composition as described in Example 1, above. The treated slag was then leached at 145° C. by the same two-stage procedure as described in example 1 above, and once again adjusting the amount of the hydrochloric acid to the impurities level in order to keep the same 20% excess of acid above stoichiometric requirement. The resulting upgraded slag composition after washing and calcination is presented in Table 4 below:

TABLE 4

| Upgraded Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 93.80 | 0.69 | 0.61 | 0.14 | 0.44 | 0.05 | 3.61 | 0.03 | 0.26 |

Example 3

SORELSLAG™ produced from Allard Lake ilmenite and having the same composition as in Example 2, Table 3, was sized by grinding and screening at 75–850 microns and was then oxidized and reduced in the same conditions as in Example 2. The thus treated slag was then leached at 145° C. for 5 hr with 20 wt % hydrochloric acid in a single stage operation with the same 20% excess of acid above stoichiometric requirements. The resulting upgraded product after washing and calcination was analysed and the results are presented in Table 5 below:

TABLE 5

| Upgraded Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 93.70 | 0.85 | 0.73 | 0.16 | 0.65 | 0.04 | 3.53 | 0.03 | 0.30 |

Example 4

A sample of SORELSLAG™ produced by electro-smelting of Allard Lake ilmenite had the composition presented in Table 6 below:

TABLE 6

| SORELSLAG ™ slag composition (wt %) | | | | | | | | |
|---|---|---|---|---|---|---|---|---|
| $TiO_2$* | $Fe_t$ | $Al_2O_3$ | CaO | MgO | MnO | $SiO_2$ | $Cr_2O_3$ | $V_2O_5$ |
| 78.30 | 8.10 | 3.82 | 0.50 | 5.21 | 0.25 | 2.73 | 0.21 | 0.59 |

(*Total Ti reported as $TiO_2$ regardless of valence state)

After sizing the grains by grinding and screening at 75–850 microns, the slag was oxidized in solid state with air at 1050° C. for 1.5 hr and reduced at 800° C. for 1 hr with smelter gas having the composition described in example 1, above. The thus treated slag was leached at 145° C. by the same two-stage procedure as shown in example 1 and by adjusting the amount of hydrochloric acid to the impurities level in order to keep the same 20% excess of acid above stoichiometric requirements. The resulting upgraded slag composition after washing and calcination had a composition as shown in Table 7 below:

TABLE 7

| Upgraded Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 94.20 | 0.65 | 0.67 | 0.12 | 0.39 | 0.03 | 3.30 | 0.05 | 0.14 |

Example 5

A sample of commercial Richards Bay™ slag from the Eastern coast of Republic of South Africa was produced by electro-smelting of beach sand ilmenite and exhibited the composition presented in Table 8 below:

TABLE 8

| Richards Bay ™ Slag Composition (wt %) | | | | | | | | |
|---|---|---|---|---|---|---|---|---|
| $TiO_2$* | $Fe_t$ | $Al_2O_3$ | CaO | MgO | MnO | $SiO_2$ | $Cr_2O_3$ | $V_2O_5$ |
| 86.20 | 7.15 | 1.45 | 0.13 | 1.03 | 1.55 | 1.85 | 0.17 | 0.44 |

(*total Ti reported as $TiO_2$ regardless of valance state)

The slag sample was sized by grinding and screening at 75–850 microns and was then oxidized in solid state with air at 1000° C. for 1 hour. The treated slag was then reduced with smelter gas, having a composition as described in Example 1, above, at 800° C. for 1 hour. The thus treated slag was then leached at 140° C. with 30 wt % sulphuric acid in a single stage using 20% acid in excess of stoichiometric requirements. The resulting upgraded slag product after washing and calcination was analysed and exhibited the composition shown below in Table 9:

TABLE 9

| Upgraded Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 93.70 | 1.80 | 0.48 | 0.07 | 0.34 | 0.43 | 1.38 | 0.08 | 0.32 |

Example 6

Richards Bay™ slag having the same composition and grain size distribution as in Example 5 was oxidized and then reduced in the same conditions as in Example 5. The treated slag was then leached at 140° C. with 20 wt % hydrochloric acid in a single stage using the stoichiometric amount of acid. The composition of the resulting upgraded slag after washing and calcination is presented below in Table 10:

TABLE 10

| Upgraded Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 94.80 | 0.82 | 0.41 | 0.10 | 0.13 | 0.18 | 1.50 | 0.08 | 0.32 |

Example 7

SORELSLAG™ was sized by grinding and screening at 75–850 microns and then was upgraded by physical means to attempt to decrease $SiO_2$ content. The slightly beneficiated slag used as a starting material had the composition presented below, Table 11:

TABLE 11

| Modified SORELSLAG ™ Slag Composition (wt %) | | | | | | | | |
|---|---|---|---|---|---|---|---|---|
| $TiO_2$* | $Fe_t$ | $Al_2O_3$ | CaO | MgO | MnO | $SiO_2$ | $Cr_2O_3$ | $V_2O_5$ |
| 82.66 | 7.09 | 2.77 | 0.35 | 5.29 | 0.24 | 1.66 | 0.19 | 0.64 |

(*total Ti reported as $TiO_2$ regardless of valance state)

The slag was oxidized with air at 1050° C. for 1 hour and then reduced at 800° C. for 1 hour with smelter gas. The treated slag was subsequently cooled to room temperature under $N_2$ flow and leached at 145° C. with 20 wt % hydrochloric acid solution. A 20% excess of acid above stoichiometric requirements for the removal of the acid leachable constituents of the slag was used. In the first leaching stage the slag was contacted for 3.5 hrs with 53% vol. of the total amount of hydrochloric acid solution. The first stage leachate was decanted. The partly leached slag was then contacted with the remaining 47% vol. of the hydrochloric acid solution for an additional 2.5 hrs. The second stage leachate was also decanted and the product was washed in water, calcined and analysed. The chemical composition of the resulted upgraded slag product is presented in Table 12 below:

TABLE 12

| Upgraded Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 95.68 | 0.69 | 0.66 | 0.12 | 0.55 | 0.01 | 1.96 | 0.01 | 0.29 |

Example 8

The same slightly beneficiated SORELSLAG™ as in Example 7 above was oxidized and reduced at the same conditions. The thus treated slag was then leached at 150° C. for 8 hrs with 20 wt % hydrochloric acid in a single stage operation with the same 20% excess of acid above stoichiometric requirement. The resulting upgraded product after washing and calcination was analysed and the results are presented in Table 13 below:

TABLE 13

| Upgraded Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 95.25 | 0.79 | 0.73 | 0.13 | 0.76 | 0.01 | 1.94 | 0.02 | 0.31 |

Examples 9, 10 and 11

The following Examples 9, 10 and 11 illustrate an embodiment of the present invention wherein the optional step of caustic leaching is performed after acid leaching and washing but before calcination on an upgraded slag similar to that of Example 1. The caustic leaching step serves to remove excess $SiO_2$ from the upgraded slag.

Example 9

In this example, a batch mode caustic leach is performed. 2L of 8.6 wt % of NaOH solution were mixed with 2 kg of a washed but non-calcined upgraded slag. The mixing was done in a covered stainless steel leaching vessel placed on a heating plate. Leaching time was 30 minutes at temperature of 100° C. with 40 rpm mechanical agitation. The leaching vessel was cylindrical, 8 inches in diameter and 9 inches high, made of 304L stainless steel. The chemical composition of the upgraded slag sample and the caustic leached samples are shown in Table 14, further below.

Example 10

In this example, a batch mode caustic leach is performed but this time without agitation. 5 ml of 5 wt % of NaOH solution were mixed with 10 g of washed but non-calcined sample of the upgraded slag similar to that of Example 1 in a 30 ml covered vessel. The vessel was placed in an electric furnace which was maintained at 50° C. Leaching time was 90 minutes. No agitation was provided during the test. Results are also shown in Table 14, further below.

Example 11

In this example, a continuous, counter-current caustic leach is performed. The leaching apparatus consisted of five 4-inch steel cylindrical containers, numbered 1–5 and arranged linearly. Neighbouring containers were interconnected by means of openings. Each container had a mechanical agitator turning at 30 rpm. The system was kept on a heating plate maintained at 70(±5)° C. The washed but non-calcined sample of upgraded slag was fed into container No. 1 at 50 g/min. while 5 wt % NaOH solution was pumped into container No. 5 at the rate of 20 ml/min. Residence time in the apparatus was about 45 minutes. Results are reproduced in Table 14, below:

TABLE 14

| Upgraded slag with optional caustic leaching CHEMICAL ANALYSIS OF UPGRADED SLAG* BEFORE & AFTER CAUSTIC LEACHING | | | | |
|---|---|---|---|---|
| ELEMENTS | ORIGINAL | EXAMPLE 9 | EXAMPLE 10 | EXAMPLE 11 |
| $TiO_2$ | 93.93 | 95.98 | 95.00 | 95.96 |
| $Fe_t$ | 0.76 | 0.76 | 0.90 | 0.70 |
| $Al_2O_3$ | 0.69 | 0.65 | 0.70 | 0.60 |
| CaO | 0.12 | 0.12 | 0.12 | 0.12 |

TABLE 14-continued

| Upgraded slag with optional caustic leaching CHEMICAL ANALYSIS OF UPGRADED SLAG* BEFORE & AFTER CAUSTIC LEACHING | | | | |
|---|---|---|---|---|
| ELEMENTS | ORIGINAL | EXAMPLE 9 | EXAMPLE 10 | EXAMPLE 11 |
| MgO | 0.74 | 0.73 | 0.65 | 0.56 |
| MnO | 0.05 | 0.04 | 0.03 | 0.03 |
| $SiO_2$ | 2.77 | 1.04 | 1.80 | 1.43 |
| $Cr_2O_3$ | 0.06 | 0.01 | 0.05 | 0.02 |
| $V_2O_5$ | 0.35 | 0.32 | 0.34 | 0.26 |
| $Na_2O$ | — | 0.02 | 0.02 | 0.02 |
| Cl(−) | 0.20 | — | — | — |
| g NaOH (100%) per gram of upgraded slag | | 0.094 (g) | 0.027 (g) | 0.0211 (g) |
| NaOH Solution Strength | | 8.6% | 5.0% | 5.0% |
| Leaching Mode | | batch, agitation 40 rpm | batch, no agitation | continuous, counter-current |
| Leaching Time | | 30 min. | 90 min. | 45 min. |
| Leaching Temp. | | 100° C. | 50° C. | 70° C. |

*All analyses correspond to calcined samples.
t refers to total iron content.

Example 12

In order to demonstrate the inapplicability of the prior art processes to slags, the results of using the process parameters disclosed by Sinha in G.B. patent No. 1,225,826, Example 1, page 7, to upgrade SORELSLAG™ are presented below. The sized slag used as a starting material had the composition presented below in Table 15:

TABLE 15

| SORELSLAG ™ Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 78.0 | 6.40 | 3.70 | 0.48 | 5.70 | 0.24 | 2.44 | 0.21 | 0.65 |

("t" refers to total iron content regardless of valence state)

The slag was oxidized with air at 850° C. for 2 hrs and then reduced with smelter gas at 850° C. for 5 mins. The treated slag was cooled to room temperature in a non-oxidizing atmosphere and leached with 20 wt % hydrochloric acid solution under refluxing condition for 6 hrs (although the teachings of GB Patent 1,225,826 provide for 3 hrs of leaching). The leaching temperature was maintained at 108°–110° C. and agitation was provided by shaking the leaching bombs. The 200 excess of acid above stoichiometric requirements was used. The resulting product after washing and calcination was analysed and the results are presented in Table 16 below:

TABLE 16

| Resulting Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 80.15 | 5.83 | 3.4 | 0.36 | 5.33 | 0.21 | 2.59 | 0.2 | 0.63 |

("t" refers to total iron content regardless of valence state)

As shown, a negligible removal of impurities (less than 5%) from the slag was obtained.

Example 13

To further demonstrate the inapplicability of the process conditions taught in GB Patent 1,225,826, oxidizing and reduction conditions were modified. The same slag of the prior example was oxidized with air at 900° C. for 1 hr and then reduced at 900° C. with smelter gas for 30 mins. The thus treated slag was leached at the same conditions as above. The resulting product had the composition almost the same as slag. After washing and calcination the product was analysed and the composition is shown in Table 17 below:

TABLE 17

| Resulting Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 81.85 | 5.16 | 3.39 | 0.37 | 4.62 | 0.21 | 2.69 | 0.20 | 0.64 |

("t" refers to total iron content regardless of valence state)

In this case also, a negligible removal of impurities was observed.

Example 14

Still to demonstrate the inapplicability of the process conditions taught in GB Patent 1,225,826, oxidizing and reduction conditions were again modified. The commercial sized SORELSLAG™ similar to that of Example 1 was used as a starting material. The slag was oxidized with air at 1050° C. for 2 hrs and then reduced with smelter gas at 800° C. for 2 hrs. The oxidation and reduction was done in a 14" pilot plant fluid bed reactor.

The well oxidized and reduced slag was leached with 20% HCl at 110° C. in the two-stages. In the first leaching stage the treated slag was contacted for 3 hours with 55% vol. of the total amount of hydrochloric acid solution. The first stage leachate was decanted and the treated slag was again contacted with remaining 45% of the 20 wt % HCl solution for additional 3 or 4 hrs. The second stage leachate was also decanted and resulted product after washing and calcination was analysed. The new 6 hrs. of total leaching time gave the chemical composition shown in Table 18, below:

TABLE 18

| Resulting Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 84.20 | 4.37 | 2.29 | 0.13 | 3.82 | 0.16 | 2.79 | 0.14 | 0.54 |

Extension of the total leaching time to 7 hrs (4hrs in the second stage) gave the product with a composition as shown in Table 19, below:

TABLE 19

| Resulting Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 84.47 | 3.99 | 2.25 | 0.15 | 3.67 | 0.16 | 3.08 | 0.13 | 0.53 |

Once again, it has been shown that a negligible upgrading of the slag has been achieved even if the acid leaching period was lengthened.

Example 15

The inapplicability of the prior art processes to slags were again demonstrated by using the process parameters in U.S. Pat. No. 3,825,419. The results of these tests are presented below. The sized slag of Example 12 was reduced with smelter gas at 900° C. for 1 hr and was then leached with 20% HCl at 120° C. in two stages. In the first leaching stage the treated slag was contacted for 4 hrs with 60% vol. of the total amount of hydrochloric acid solution. The first stage leachate was decanted and the treated slag was again contacted with remaining 40% of the 20 wt % HCl solution for an additional 3 hrs. The second stage leachate was also decanted and resulted product after washing and calcination was analysed and the results are presented in Table 20 below:

TABLE 20

| Resulting Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 79.35 | 5.74 | 3.62 | 0.41 | 5.23 | 0.19 | 2.39 | 0.22 | 0.68 |

("t" refers to total iron content regardless of valence state)

Example 16

The slag of Example 12 was again treated at the same conditions with smelter gas and leached using the same procedure. The leaching was done at 140° C. The resulted product after washing and calcination was analysed and the results are presented in Table 21, below:

TABLE 21

| Resulting Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 80.30 | 4.84 | 3.17 | 0.39 | 4.62 | 0.20 | 2.70 | 0.16 | 0.59 |

Example 17

Still further, the inapplicability of the prior art processes was demonstrated against the process disclosed by Rado, in U.S. Pat. No. 4,199,552, Example 1. Once again, this process is aimed at treating ilmenite ores as opposed to slags. It is noteworthy to mention that the first two process steps are in inverse order when compared to the process of the present invention. The result is that the slags are not properly treated and remain impervious to leaching.

The sized slag of Example 12 was reduced with smelter gas at 1000° C. for 1 hr and oxidized with a mixture of 80 vol % $N_2$, 13 vol % $CO_2$, 5 vol % of smelter gas and 2 vol % water vapour (to have the oxygen partial pressure close to $10^{-6}$ atm.) and then was leached with 20 wt % HCl at 143° C. in two-stage procedure. In this case, the 40% excess of acid above stoichiometric requirements which is recommended in the patent disclosure, was used. The treated slag was contacted for 3 hrs with about 55% vol. of the total hydrochloric solution. This stage leach liquor was decanted and the slag was contacted with the remaining acid solution for the additional 3 hrs in the second leaching stage at 143° C. There was a very little weight loss of slag after the leaching (less than 1%), which indicates a very poor leaching efficiency. The second stage leach liquor was decanted, washed and calcined at 800° C. The composition of the product is presented in Table 22, below:

TABLE 22

| Resulting Slag Composition (wt %) | | | | | | | | |
|---|---|---|---|---|---|---|---|---|
| $TiO_2$ | $Fe_t$ | $Al_2O_3$ | CaO | MgO | MnO | $SiO_2$ | $Cr_2O_3$ | $V_2O_5$ |
| 79.25 | 5.97 | 3.59 | 0.39 | 5.48 | 0.21 | 2.49 | 0.23 | 0.68 |

The foregoing examples illustrate how the method of the present invention can be advantageously used to upgrade titania slags into a high grade $TiO_2$ feedstock suitable for the chloride process of pigment production.

Although the invention has been described above with respect to one specific form, it will be evident to a person skilled in the art that it may be modified and refined in various ways. It is therefore wished to have it understood that the present invention should not be limited in scope, except by the terms of the following claims.

What is claimed is:

1. A method to upgrade a titania slag to obtain a high $TiO_2$-containing product having residual impurity content and grain size distribution suitable for use as a feedstock in a chloride process of titanium dioxide pigment production, said titania slag containing reduced titanium oxides and impurities including at least one member selected from the group consisting of iron oxide, manganese oxide, chromium oxide, vanadium oxide, aluminum oxide, silicon oxide and alkaline-earth oxides, said at least one member being distributed in a pseudo-brookite phase and a glassy silicate phase, the method comprising:

(a) sizing the titania slag to a particle size range of from 75 microns to 850 microns;

(b) oxidizing the sized titania slag by contacting the sized titania slag with an oxygen containing gas at a temperature of at least about 950° C. for a period of at least about 20 minutes such that a portion of the iron oxide is converted to a ferric state, such that reduced titanium oxides are converted to a tetravalent state, and such that at least a major portion of a glassy silicate phase is decomposed;

(c) reducing the oxidized titania slag in a reducing atmosphere at a temperature of at least about 700° C. for a period of at least about 30 minutes such that the ferric state iron oxide is converted to a ferrous state;

(d) leaching the reduced titania slag with mineral acid at a temperature of at least 125° C. and under a pressure in excess of atmospheric pressure to yield an upgraded leached slag product and a leachate; and (e) washing and calcining the upgraded leached slag product by heating at a temperature in the range of from 600° C. to 800° C.

2. The method of claim 1 wherein the resulting upgraded slag product contains at least 90% by weight of titanium dioxide and less than 1% by weight of magnesium oxide and less than 0.2% by weight of calcium oxide.

3. The method of claim 1 wherein the alkaline-earth oxide impurities contained in the titania slag comprise magnesium oxide and calcium oxide.

4. The method of claim 2 or 3 wherein the titania slag contains at least 3% by weight of iron oxides.

5. The method of claim 4 wherein said titania slag contains at least 1% by weight of magnesium oxide and at least 0.2% by weight of calcium oxide.

6. The method of claim 1 wherein prior to step (b), the titania slag is preheated to improve performance of step (b) and step (b) is conducted in a fluidized bed reactor.

7. The method of claim 1 wherein step (b) is conducted in a fluidized bed.

8. The method of claim 7 wherein step (b) is conducted at a temperature range of from about 1000° C. to 1100° C.

9. The method of claim 7 wherein step (b) is conducted for a period of between 1 and 2 hours.

10. The method of claim 7 wherein a fluidizing gas contains in excess of 2% oxygen.

11. The method of claim 1 wherein step (c) is conducted using a reducing agent that includes at least one member selected from the group consisting of carbon monoxide, hydrogen gas, smelter gas, reformed natural gas and coal.

12. The method of claim 11 wherein step (c) is conducted in a fluidized bed reactor at a temperature range of from about 700° to 900° C.

13. The method of claim 12 wherein step (c) is conducted at a temperature range of about 800° to 850° C.

14. The method of claim 13 wherein step (c) is conducted for a period of about 1½ to 2 hours.

15. The method of claim 1 wherein step (d) is conducted at a temperature range of 140° to 160° C., under agitation and at a pressure of at least about 50 psi.

16. The method of claim 15 wherein step (d) is a multiple stage leaching operation.

17. The method of claim 1 wherein said mineral acid includes at least one acid selected from the group consisting of sulfuric acid and hydrochloric acid.

18. The method of claim 17 wherein step (d) is a single stage leaching operation.

19. The method of claim 17 wherein step (d) is a two stage leaching operation.

20. The method of claim 17 wherein the mineral acid is present in at least a 10% stoichiometric excess of what is needed to convert leachable oxides and alkaline-earth impurities to soluble chlorides.

21. The method of claim 20 wherein the concentration of mineral acid is at least about 15% by weight and step (d) is conducted at a pressure of at least 40 psig.

22. The method of claim 21 wherein the concentration of mineral acid is about 20% by weight and step (d) is conducted at a pressure of from 50 psig to 70 psig.

23. The method of claim 1 wherein step (e) comprises the sequential steps of separating the upgraded leached slag product from the leachate, washing the upgraded leached slag product with water, drying the upgraded leached slag product and then calcining said upgraded leached slag product.

24. The method of claim 15 wherein the leaching is conducted at a temperature of about 150° C.

25. The method of claim 24 wherein the reduced titania slag is contacted with the mineral acid for a time of 3 to 7 hours.

26. The method of claim 1 conducted in continuous mode as a continuous process.

27. The method of claim 1 conducted in batch mode.

28. The method of claim 1 wherein step (e) includes a caustic leaching of the upgraded leached slag product that is conducted after said washing and prior to said calcining.

29. The method of claim 28 wherein said caustic leaching is conducted under agitation and in batch mode.

30. The method of claim 28 wherein said caustic leaching is conducted under agitation in continuous mode.

31. The method of claim 29 wherein said caustic leaching is performed with a sodium hydroxide solution at a temperature of at least about 50° C.

32. The method of claim 30 wherein said caustic leaching is performed with a sodium hydroxide solution at a temperature of at least about 50° C.

33. A method of treating a titania slag to obtain an intermediate product including rutile, pseudo-brookite and ilmenite, said titania slag containing reduced titanium oxides and impurities including at least one member selected from the group consisting of iron oxide, manganese oxide, chromium oxide, vanadium oxide, aluminum oxide, silicon oxide and alkaline-earth oxides, said at least one member being distributed in a pseudo-brookite phase and a classy silicate phase, the method comprising:

(a) sizing the titania slag to a particle size range of from 75 microns to 850 microns;

(b) oxidizing the sized titania slag by contacting the sized titania slag with an oxygen containing gas at a temperature of at least about 950° C. for a period of at least about 20 minutes such that a portion of the iron oxide is converted to a ferric state, such that reduced titanium oxides are converted to a tetravalent state, and such that at least a major portion of a glassy silicate phase is decomposed; and (c) reducing the oxidized titania slag in a reducing atmosphere at a temperature of at least about 700° C. for a period of at least about 30 minutes such that the ferric state iron oxide is converted to a ferrous state.

34. A titaniferous intermediate product produced by the process of claim 33.

35. The method of claim 33, wherein the intermediate product includes rutile and ilmenite and wherein pseudo-brookite is substantially removed.

36. The method of claim 33, wherein the resulting intermediate product includes rutile and pseudo-brookite.

* * * * *

UNITED STATES PATENT AND TRADEMARK OFFICE

CERTIFICATE OF CORRECTION

PATENT NO. : 5,830,420
DATED : October 3, 1998
INVENTOR(S) : Borowiec, et al.

It is certified that error appears in the above-identified patent and that said Letters Patent is hereby corrected as shown below:

Claim 33, line 8, replace "classy" with --glassy--.

Claim 35, line 2-3, delete "and wherein pseudo-brookite is substantially removed".

Signed and Sealed this

Ninth Day of March, 1999

*Attest:*

Q. TODD DICKINSON

*Attesting Officer*

*Acting Commissioner of Patents and Trademarks*